US005109792A

United States Patent [19]

Baldini

[11] Patent Number: 5,109,792

[45] Date of Patent: May 5, 1992

[54] COATING HEAD FOR APPLYING A COATING SUSPENSION LAYER ON A PAPER SHEET

[75] Inventor: Giorgio Baldini, San Pietro Val Lemina, Italy

[73] Assignee: Beloit Corporation, Beloit, Wis.

[21] Appl. No.: 657,573

[22] Filed: Feb. 19, 1991

[30] Foreign Application Priority Data

Feb. 16, 1990 [IT] Italy ..... 67115 A/90

[51] Int. Cl.[5] ..... B05C 5/02

[52] U.S. Cl. ..... 118/410; 118/413; 118/419

[58] Field of Search ..... 118/410, 419, 261, 413, 118/126

[56] References Cited

U.S. PATENT DOCUMENTS

| | | | |
|---|---|---|---|
| 4,369,731 | 1/1983 | Damrau | 118/410 |
| 4,387,663 | 6/1983 | Alheid | 118/413 |
| 4,405,661 | 9/1983 | Alheid | 118/410 |
| 4,534,309 | 8/1985 | Damrau et al. | 118/413 |
| 4,780,336 | 10/1988 | Damrau | 118/413 |
| 4,880,671 | 11/1989 | Sollinger et al. | 118/413 |

*Primary Examiner*—Karen M. Hastings

*Attorney, Agent, or Firm*—Dirk J. Veneman; Raymond W. Campbell; David J. Archer

[57] ABSTRACT

The coating head substantially comprises an elastic blade thrust against the paper sheet which is transported by a rotating cylinder, and a chamber fit for containing a coating suspension which is delimited by a portion of the outer surface of the cylinder and by the blade and which communicates with a feeding line of the suspension; moreover, said chamber is delimited by a deflector plate, the position of which, in relation to the cylinder, can be adjusted so as to define an exhaust port for the coating suspension between it and the surface of the cylinder; according to the invention, the deflector plate is provided with a blocking element which can be elastically deformed and fit for limiting the passage of the coating suspension through said exhaust port, said element presenting a free edge facing the cylinder which is parallel to the cylinder axis.

1 Claim, 3 Drawing Sheets

COATING HEAD FOR APPLYING A COATING SUSPENSION LAYER ON A PAPER SHEET

Figure 1:
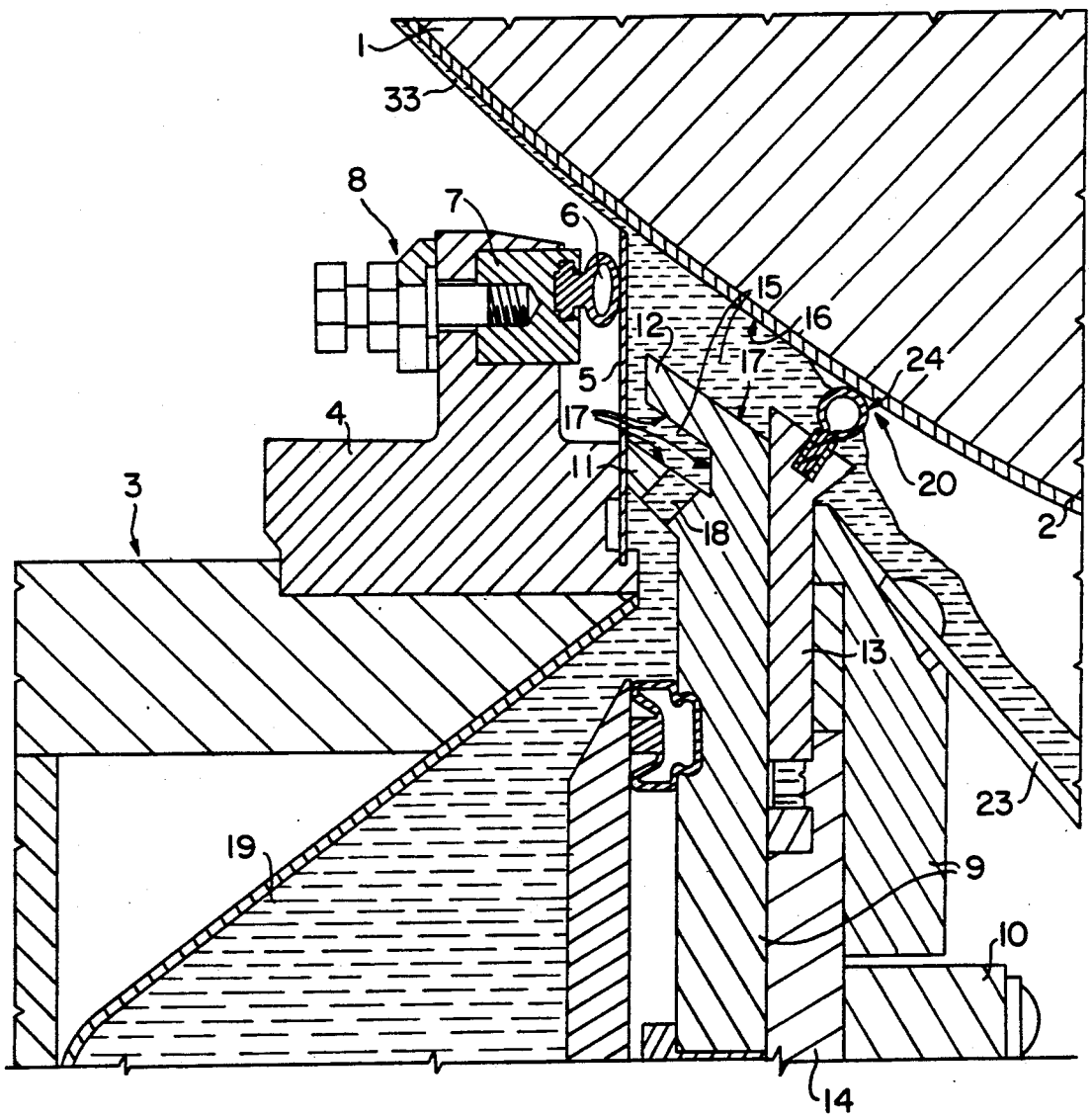

The present invention relates to a coating head which is part of a coating machine and which is fit for applying a layer of coating suspension on a continuous paper sheet transported by a rotating cylinder.

A head of this type substantially comprises an elastic blade which is thrust against the sheet and the function of which is to form said coating suspension layer and a chamber for containing the suspension: apart from other elements of the head, said chamber is delimited by said blade and by a portion of the outer surface of the cylinder and communicates with a feeding line through which the suspension is pressurized to the chamber.

Moreover, said chamber is delimited by a deflector plate the position of which, in relation to the cylinder, can be adjusted so as to define, between said deflector plate and the surface of the cylinder, a suitably-sectioned exhaust port for the suspension.

During the rotation of the cylinder, the outer surface of the paper sheet is brought into contact with the coating suspension contained in the aforedescribed chamber, while the extremity of the elastic blade operates a buttering of the suspension, so as to generate a layer of suspension of predetermined thickness on said surface. Therefore, a certain recirculation of coating suspension takes place in the suspension being discharged from the chamber through the aforedescribed exhaust port.

The rotating heads of the type briefly described present some drawbacks.

Above all, in many cases, the surface of the coating obtained on the sheet turns out to be uneven: printing defects are often found on sheets showing said drawback.

Besides, with the heads of the aforedescribed type, the surface of the cylinder can easily get damaged, particularly in case of a sudden break of the sheet; in that case, the extreme edge of the deflector plate can actually come into contact with the surface of the cylinder.

Finally, the flow rate of the suspension discharged from said chamber through the relative exhaust port can be excessively high, generating an excessive recirculation ratio of the suspension; this is mainly due to the fact that the extreme edge of the deflector plate has to be placed at a rather high distance from the surface of the cylinder in order to avoid, in particular working conditions of the coating head, the interference between said edge and surface.

The object of the present invention is to provide a coating head of the type briefly described with which the drawbacks mentioned before can be eliminated and, therefore, a head which is fit for providing substantially even coating layers, which does not cause damages to the cylinder in case of a break of the sheet and from which the flow rate of the suspension discharged is low.

Another object of the present invention is to provide a coating head of the type described with which high suspension pressures can be obtained in the chamber defined before. Said objects are attained by means of a coating head fit for applying a layer of coating suspension on a continuous paper sheet transported by a rotating cylinder, said head substantially comprising an elastic blade thrust against said sheet, and a chamber fit for containing a coating suspension and delimited by a portion of the outer surface of said cylinder and by said blade and communicating with a feeding line of said coating suspension, moreover said chamber being delimited by a deflector plate, the position of which, in relation to said cylinder, can be adjusted so as to define an exhaust port for said coating suspension between the plate and said surface of the cylinder, characterized in that said plate is provided with a blocking element which can be elastically deformed, fit for limiting the passage of said suspension through said exhaust port, said element presenting a free edge facing said cylinder and parallel to the cylinder axis.

Figure 2:
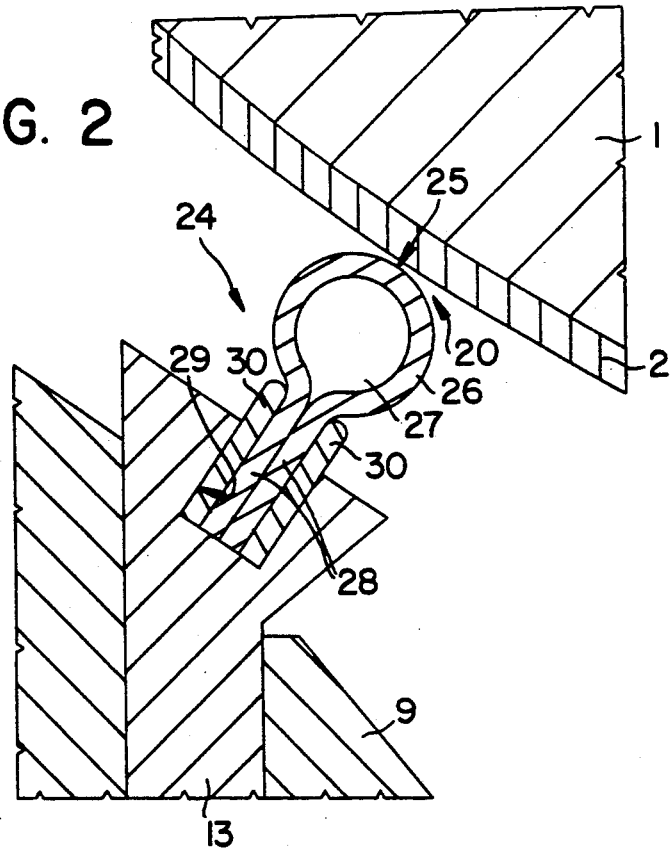
Figure 3:
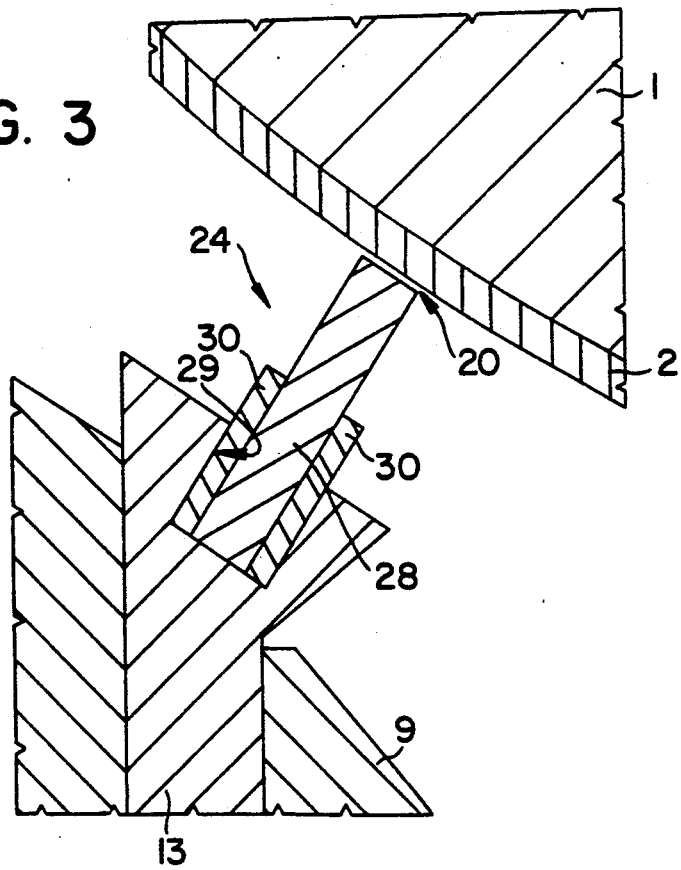
Figure 4:
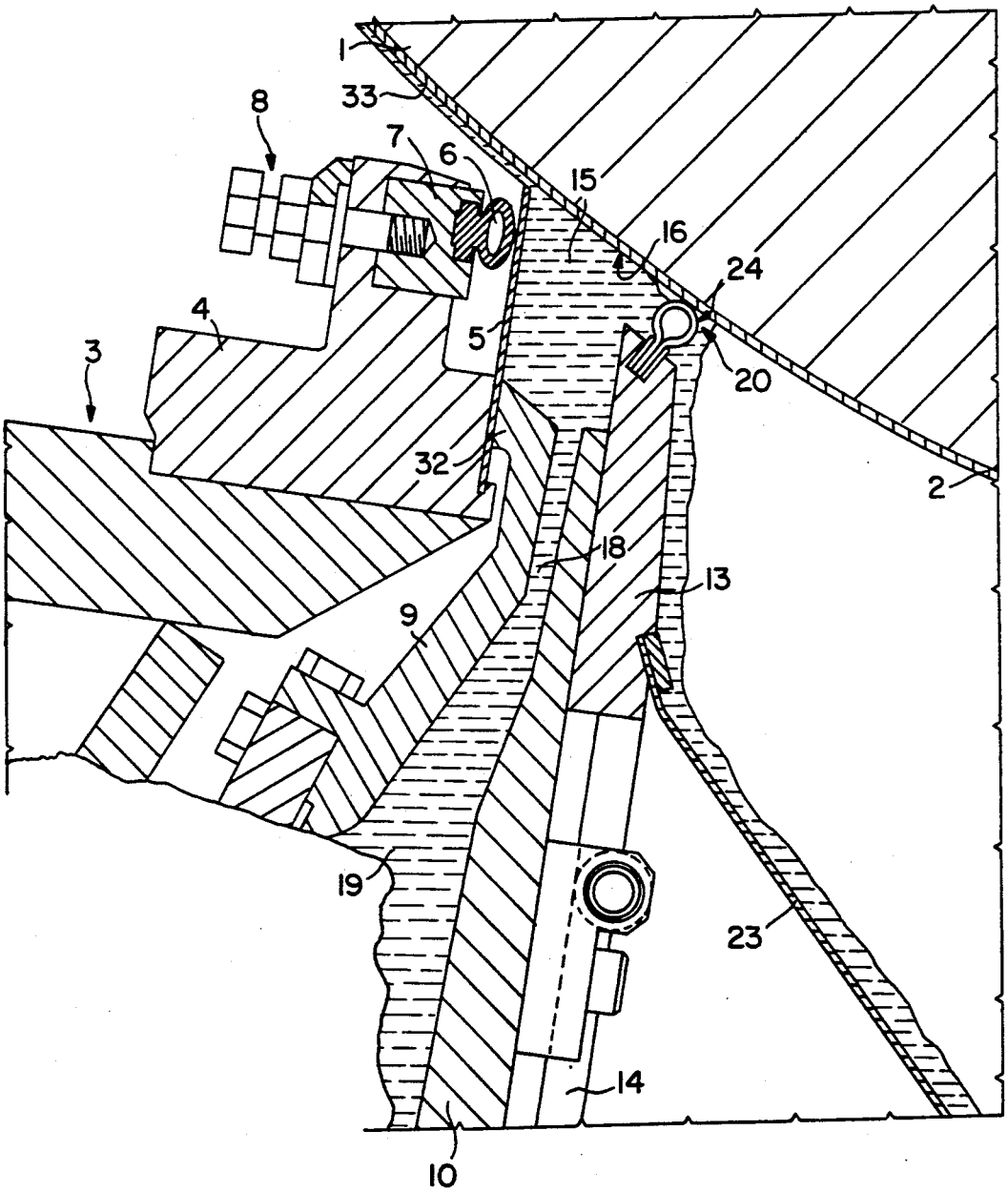

The structure of the coating head of the present invention will be more apparent from the description of two particular embodiments thereof given hereafter by way of example, with reference to the accompanying drawings in which:

FIG. 1 is a section of the main elements of the coating head according to the invention, corresponding to a first embodiment of the latter, FIG. 2 shows a detail, to an enlarged scale, of some of the elements of the head of FIG. 1, FIG. 3 is a detail similar to the one of FIG. 2 in which the elements have a shape different from that of the elements of FIG. 2, FIG. 4 is a section of the main elements of another embodiment of the coating head according to the invention.

The coating head of the invention, which can be part of an installation for the making of a continuous paper sheet, substantially comprises a rotating cylinder 1 on the outer surface of which a continuous paper sheet 2 rests, said sheet being transported by the cylinder during its rotation. Besides, the head comprises a casing 3 to which there is fixed a support 4 fit for holding up an elastic blade 5 which is thrust against the sheet 2 by an air bearing 6 carried by a block 7, adjustable, by means of a screw mechanism 8, on the support 4. The air bearing 6 substantially comprises a conduit made of a material which can be deformed, for example of rubber, within which compressed air can be supplied.

A frame 10, which is oscillating in relation to the casing 3, carries a beam 9 the longitudinal axis of which is parallel to the axis of the cylinder 1; said beam presents a first tongue 11 fit for pressing on the lower part of the blade 5 to block it in relation to the support 4 and a second tongue 12 interposed between the first one and the surface of the cylinder 1.

Besides, a deflector plate 13, the longitudinal axis of which is also parallel to the axis of the cylinder 1, is mobile and guided on the beam 9 and its position can be adjusted in relation to the cylinder; to this end, said plate is connected to arms 14 operated, in their turn, by suitable actuators (not shown). As can be seen in FIG. 1, the movement of deflector plate 13 along the guide means is in a direction which defines a constant angle relative to a direction of movement of the web.

A chamber 15 fit for containing a coating suspension is defined by the elements described before and is delimited, substantially, by the portion 16 of the outer surface of the cylinder 1, by the inner surface of the blade 5 and by the surfaces 17 of the tongues 11, 12 and of the beam 9. Moreover, said chamber is delimited by the deflector plate 13.

The chamber 15 communicates, through a feeding line 18 provided in the tongue 11, with a coating suspension collection 19 into which said suspension is sent by means of appropriate means (not shown); moreover, the chamber 15 communicates with the exhaust through the exhaust port 20 from which the suspension runs on an appropriate deflector plate 23.

According to the invention, the deflector plate 13 is provided with a blocking element 24 which can be elastically deformed and fit for limiting the passage of the coating suspension through the exhaust port 20; said element presents a free edge 25, facing the cylinder 1, which is parallel to the cylinder axis (FIG. 2).

The blocking element 24 is placed on the deflector plate 13 so that the distance between the free edge 25 and the surface of the cylinder 1 is comprised between 0 and 4 mm. Said element is conveniently made of rubber or of an elastomer material. It is long and presents sections perpendicular to its longitudinal axis having the same shape and dimensions; said sections can be of the type shown in FIG. 2 and, therefore, comprise a part 26 substantially ring-shaped, or said sections can be substantially rectangular as shown in the embodiment of FIG. 3. Besides, the blocking element can conveniently present a longitudinal inner cavity 27 so that the element can be deformed more easily. Said element can be fixed to the deflector plate 13, as shown in FIG. 2, housing an extremity part 28 of the element within an appropriate plate 13. Moreover, between the extreme edge 28 of the blocking element 24 and the groove 29, there can be interposed appropriate plates 30.

It is apparent that the blocking element 24 can be of any section provided it can generate an edge 25 parallel to the axis of the cylinder 1 and is able to cooperate with the surface of the cylinder as will be described hereinafter.

The coating head described operates in the following way. During the rotation of the cylinder 1, the paper sheet 2 is brought into contact with the coating suspension contained within the chamber 15; therefore, the suspension adheres to the outer surface of the sheet and is buttered on it and conveniently smoothed by the action of the extremity of the elastic blade 5; in this way, on the sheet which is downstream of the blade, there is formed a layer 33 of the appropriate thickness, according to the force with which the blade is thrust against the cylinder 1.

During the rotation of the cylinder, there takes place a certain recirculation of the coating suspension within the chamber 15, said suspension being supplied by the feeding line 18 and discharged through the exhaust port 20. It has been noticed that when the coating head is provided with the blocking element 24, the coating layer is deprived of the defects that were noticed when using coating heads without said element.

Actually, the layer obtained with the head according to the invention presents a surface and a thickness substantially even; this favorable result is due to the fact that within the chamber 15 there are rather high pressures of the coating suspension, much higher than those noticed in the previous coating heads. This can be explained through the action operated by the blocking element 24 which noticeably reduces the losses of suspension through the exhaust port 20. Actually, the blocking element 24 is deformed according to the pressures which are transmitted to it by the coating suspension and, therefore, the section of the exhaust port 20 can be adjusted as required by suitably choosing the resistance of the blocking element 24.

Besides, it has been noticed that, in case of a sudden break of the sheet 2, no damages are caused to the cylinder 1; actually, in that case, the blocking element 24 operates an effective protective action by preventing the upper edge of the deflector plate 23 from coming into contact with the surface of the cylinder and damaging it.

Moreover, the flow rate of the suspension discharged through the exhaust port 20 is very low and much lower than the one noticed with the heads of the previous type; as a result, the recirculation of the suspension within the chamber 15 can be noticeably reduced.

Finally, the coating head in accordance with the invention can operate with rather high coating suspension pressures within the chamber 15; here again, this favorable result depends on the presence of the blocking element 24 which prevents the pressure from suddenly dropping at the exhaust port 20. Actually, it has been noticed that the values of the pressures within the chamber 15 can be three times higher than those obtained in the coating heads of the previous type. The possibility to operate with higher pressures within the chamber 15, and not very different from those in the main feed line 19, enables one to obtain better working conditions. It has also been noticed that the best results are obtained when the distance between the free edge 25 and the surface at the cylinder 1 is comprised within the range previously mentioned (0–4 mm).

It is apparent that the improvement of the invention can be applied to a coating head with a structure different from the one described, for example, on a coating head of the type shown in FIG. 4. Some of the elements of the head have a shape and/or a structure different from the corresponding elements of the head of FIG. 1; the corresponding elements have been indicated with the same reference numerals in both cases. In particular, the chamber 15 for the suspension has a simpler shape than that of the head of FIG. 1 and the deflector plate 13 is directly mobile on the oscillating frame 10, while the only function of the beam 9 is to block the blade 5 with the extremity projection 32; moreover, the feeding line 18 to the chamber 15 is, in this case, defined between the beam 9 and the oscillating frame 10.

It is apparent that modifications, either of shape or arrangement of the different parts, can be made to the embodiment described in accordance with the present invention provided they do not leave the scope of the invention.

I claim:

1. A short dwell coater apparatus for applying coating material onto a web supported and guided by a rotatable backing roll, said apparatus comprising:

a housing disposed adjacent to the backing roll such that the web is disposed between the backing roll and said housing, said housing defining a chamber, said chamber being connected to a pressurized source of the coating material;

a flexible blade disposed downstream relative to said chamber and extending from said housing to the web for metering the coating material applied to the web moving past said chamber;

a deflector plate having a distal end for defining a variable exhaust port, said plate being disposed upstream relative to said chamber, and adjustably secured to said housing such that movement of said plate relative to the web is permitted;

guide means defined by said housing for slidably guiding said plate such that said movement of said plate is in a direction which defines a constant angle relative to a direction of movement of the web; and said distal end including:

a flexible seal of ring-shaped cross-sectional configuration such that when said plate moves relative to said guide means, said flexible seal and the web defined therebetween said variable exhaust port.

* * * * *

UNITED STATES PATENT AND TRADEMARK OFFICE

CERTIFICATE OF CORRECTION

PATENT NO. : 5,109,792

DATED : May 5, 1992

INVENTOR(S) : Giorgio Baldini

It is certified that error appears in the above-indentified patent and that said Letters Patent is hereby corrected as shown below:

Column 4, Line 66: Please delete "defined" and insert ---define--- in place thereof.

Signed and Sealed this

Eighteenth Day of October, 1994

Bruce Lehman

*Attest:*

BRUCE LEHMAN

*Attesting Officer*

*Commissioner of Patents and Trademarks*